US005868498A

United States Patent [19]

Martin

[11] Patent Number: 5,868,498

[45] Date of Patent: Feb. 9, 1999

[54] MAGNETIC POCKET CARD

[75] Inventor: John J. Martin, Louisville, Ky.

[73] Assignee: Crane Productions, Inc., Louisville, Ky.

[21] Appl. No.: 905,037

[22] Filed: Aug. 1, 1997

Related U.S. Application Data

[63] Continuation of Ser. No. 484,990, Jun. 7, 1995, abandoned, which is a continuation-in-part of Ser. No. 915,537, Jul. 20, 1992, Pat. No. 5,458,282.

[51] Int. Cl.[6] ..... B65D 33/14

[52] U.S. Cl. ..... 383/11; 40/600; 206/818

[58] Field of Search ..... 206/818; 40/600; 383/11; 229/304, 305

[56] References Cited

U.S. PATENT DOCUMENTS

| | | | |
|---|---|---|---|
| 769,536 | 9/1904 | Dixon | 229/305 |
| 3,007,568 | 11/1961 | Kurland | 206/818 |
| 3,184,150 | 5/1965 | Hubbard | 229/305 |
| 3,237,327 | 3/1966 | Griggs | 40/600 |
| 3,782,012 | 1/1974 | Price . | |
| 4,044,942 | 8/1977 | Sherwood | 229/305 |
| 5,156,274 | 10/1992 | Williams, Jr. et al. | 206/818 |
| 5,261,174 | 11/1993 | Blegen . | |
| 5,375,351 | 12/1994 | King et al. . | |

FOREIGN PATENT DOCUMENTS 1192312 8/1988 Japan .

OTHER PUBLICATIONS

The 1990 Catalog of Magnet, Inc.

A 1990 promotional mailer of Magnet, Inc.

*Primary Examiner*—Stephen P. Garbe
*Attorney, Agent, or Firm*—Middleton & Reutlinger; James C. Eaves, Jr.; Daniel C. Stelter

[57] ABSTRACT

A magnetic pocket card, including: a planar blank having a first planar surface and a second planar surface, the planar blank having a fold line thereacross, the fold line dividing the planar blank into a pocket back portion and a pocket front portion, the planar blank being folded along the fold line, the pocket front portion being secured to the pocket back portion at at least one preselected location on the first planar surface thereby forming a pocket between the pocket back portion and the pocket front portion; and, a thin, flexible, magnetic sheet material having magnetic materials therein, the magnetic sheet material being capable of magnetically holding the magnetic pocket card to a magnetic substance, the magnetic sheet material being secured to the second planar surface on the pocket back portion. The pocket can receive a menu, coupons, phone listing, or the like. The planar blank can have an additional section attached to the pocket back portion which may include a coupon portion and/or a hang tag portion. The additional section can be sized to fold over the pocket and even fold over the magnet to protect the insert and magnet for distribution.

12 Claims, 12 Drawing Sheets

MAGNETIC POCKET CARD

This application is a continuation, of application Ser. No. 08/484,990, filed Jun. 7, 1995, now abandoned. which is a continuation-in-part ("CIP") application to my U.S. patent application Ser. No. 07/915,537, filed Jul. 20, 1992 now U.S. Pat. No. 5,458,282.

BACKGROUND OF THE INVENTION (a) Field of the Invention

The present invention relates to cards such as post cards, greeting cards, advertising cards, pocket cards and the like, and more particularly to such cards having a magnet for removably attaching the card to a magnetic surface for display of the card. The preferred embodiment of this CIP application is a magnetic pocket card, wherein a card is folded to form a pocket for holding an insert, the pocket having a magnetic material adhered thereto so that the magnetic pocket card can be placed onto a metallic surface, for example, a side of a refrigerator.

(b) Description of the Prior Art

There are no pocket cards known to me which include a magnetic material which can be used to attach the card to a magnetic surface for displaying the card and permitting access to the insert in the pocket card.

U.S. Pat. No. 4,957,311, to Geisenheimer, teaches a direct mail advertising system having a bulk mail card separable into two portions along a perforation line. U.S. Pat. No. 5,036,310, to Russell, teaches a remote mail delivery system where a permanent magnet 17 placed inside an envelope 18 or affixed to a postcard activates the electronic notification system.

SUMMARY OF THE INVENTION

The present invention provides a card having a magnet on one surface thereof for attachment to a metallic surface so that the card can be displayed. The card may be flat or folded to form a pocket for holding an insert.

The present invention further provides a card of the class described, wherein the card has first and second planar surfaces and is formed with perforations dividing the card into first and second sections and providing for the separation of the first section from the second section, and has a thin, flexible, magnetic sheet material secured to one planar surface of one of the sections.

The present invention also provides a card of the class described immediately above, wherein the thin, flexible, magnetic sheet material is dimensionally coextensive with the section of the card to which it is secured.

More particularly, in one embodiment, the present invention provides a card comprising a planar blank having a first planar surface and a second planar surface, at least one line of perforations extending across the planar blank dividing the planar blank into first and second sections providing for the separation of the first section from the second section, and a thin, flexible, magnetic sheet material adhesively secured to the first planar surface of the first section.

Also, in another embodiment, the present invention provides a card comprising a planar blank having a first planar surface and a second planar surface, a magnetized label removably attached to the card comprising a first sheet of vinyl having a front surface and a back surface with a pressure sensitive adhesive coating the front surface, a sheet of flexible magnetic material having a front surface and a back surface, geometrically identical to the first sheet, and the magnetic sheet overlaying the first vinyl sheet with the back surface of the magnetic sheet in contact with the front surface of the first vinyl sheet so that the magnetic sheet is adhesively secured to the front surface of the first vinyl sheet, a sheet of tape having a front surface and a back surface with adhesive coating both the front and back surfaces, geometrically identical to the sheet of flexible magnetic material, the sheet of tape overlaying the magnetic sheet with the back surface of the sheet of tape in contact with front surface of the magnetic sheet so that sheet of tape is adhesively secured to the magnetic sheet, and a second sheet of vinyl having a front surface and a back surface, geometrically identical with the sheet of tape, indicia printed on the second sheet of vinyl, the second sheet of vinyl overlaying the sheet of tape with the back surface of the second vinyl sheet in contact with the front surface of the sheet of tape so that the second vinyl sheet is adhesively secured to the sheet of tape, a third sheet of vinyl having a front surface and a back surface with a pressure-sensitive adhesive coating on the back surface, the back surface of the third vinyl sheet being disposed in contact with the first planar surface of the blank adhesively securing the third vinyl sheet to the first planar surface of the blank, and the label overlaying the third vinyl sheet with the back surface of the first vinyl sheet of the label in contact with the front surface of the third vinyl sheet so that the label is removably held to the third vinyl sheet by an incumbent static charge between the back surface of the first vinyl sheet of the label and the front surface of the third vinyl sheet causing the first vinyl sheet of the label to cling by adhesion to the front surface of the third vinyl sheet.

Finally, the present invention comprises a magnetic pocket card, including: a planar blank having a first planar surface and a second planar surface, the planar blank having a fold line thereacross, the fold line dividing the planar blank into a pocket back portion and a pocket front portion, the planar blank being folded along the fold line, the pocket front portion being secured to the pocket back portion at at least one preselected location on the first planar surface thereby forming a pocket between the pocket back portion and the pocket front portion; and, a thin, flexible, magnetic sheet material having magnetic materials therein, the magnetic sheet material being capable of magnetically holding the magnetic pocket card to a magnetic substance, the magnetic sheet material being secured to the second planar surface on the pocket back portion. The pocket can receive a menu, coupons, phone listing, or the like. The planar blank can have an additional section attached to the pocket back portion.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
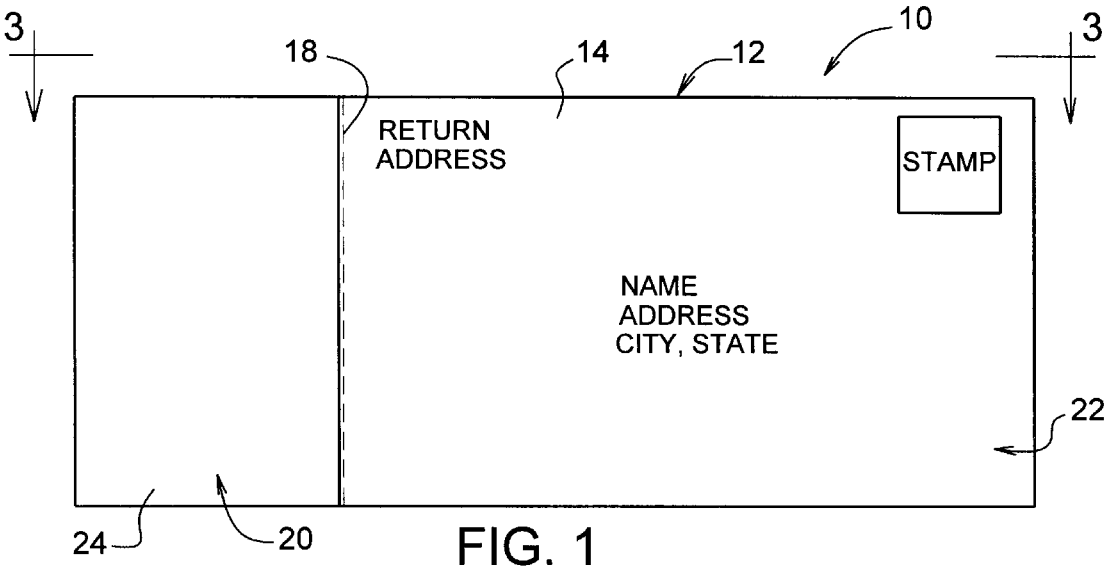
FIG. 1 is a front view of a post card incorporating features of the present invention.
Figure 2:
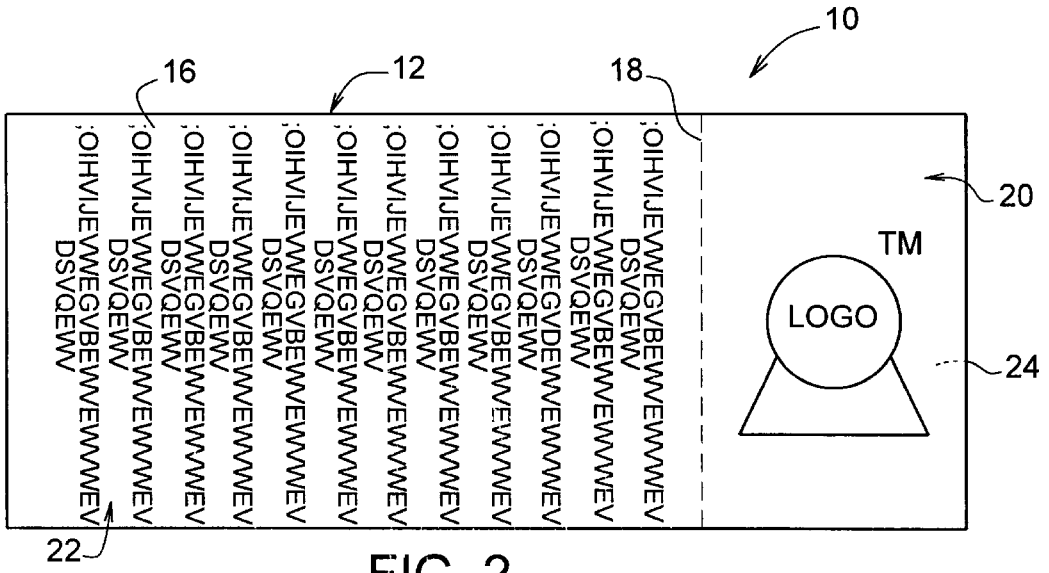
FIG. 2 is a back view of the post card of FIG. 1.
Figure 3:
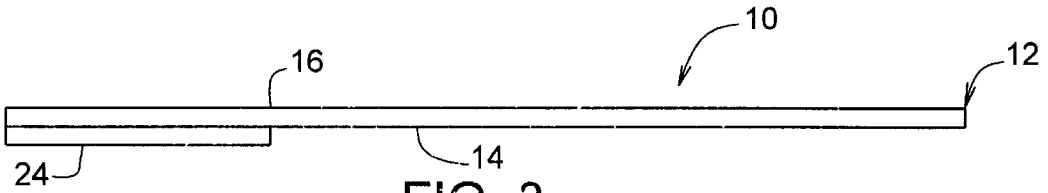
FIG. 3 is a side edge view of the post card of FIG. 1 as seen in the direction of arrows 3—3 in FIG. 1.

With reference to FIGS. 1–3, there is shown a post card, generally denoted as the numeral 10 of the present invention. The post card 10 is formed of a planar blank 12 having a first planar surface 14 and a second planar surface 16. The planar blank 12 is formed with a line of perforations 18 extending across the planar blank 12 dividing the planar blank into a first section 20 and a second section 22. The line of perforations provides for separating the first section 20 from the second section 22. A thin, flexible, magnetic sheet material 24 is adhesively secured to, for example, the first surface 14, of, for example, the first section 20. The thin, flexible, magnetic sheet material 24 is dimensionally coextensive with the first surface 14 of the first section 20. The first surface 14 of the second section 22 can be printed with indicia indicating the location of a postage stamp, location of addressee information, and location of return address information. The second surface 16 of the first section 20 as well as the second surface 16 of the second section 22 can be printed with indicia such as attractive art work, printed information, and the like.

The post card 10 can be magnetically secured to a magnetic surface, such as a refrigerator door or magnetic bulletin board, and the like, to display the card 10. Also, the first section 20 can be separated from the second section 22 along the line of perforations 18 and the separated first section 20 can then be magnetically secured to a magnetic surface, such as a refrigerator door or metallic bulletin board to display the indicia on the second surface 16 of the first section 20. Also, the first section 20 can be used to magnetically attach other sheets of paper, such as notes, to the magnetic surface.

The thin sheet of flexible magnetic material 24 is known and is a vinyl material including magnetic materials dispersed therethrough. Such a sheet of flexible magnetic material can be commercially purchased under the trademark "UltraMag" from Flex-Mag Industrial, Inc., a Division of Dynacast Co., Marietta, Ohio.

Figure 4:
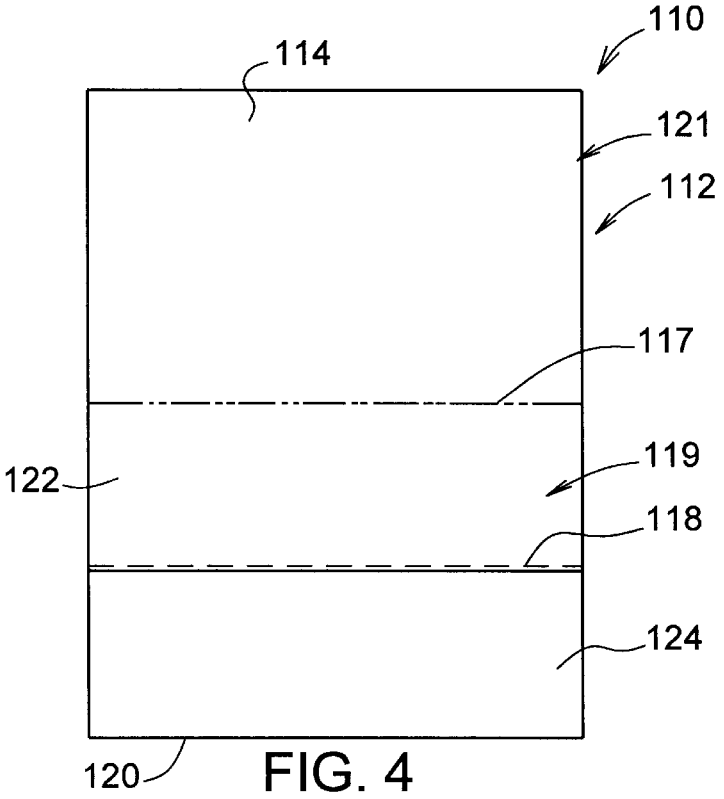
FIG. 4 is a front view of one embodiment of a greeting card incorporating features of the present invention.
Figure 5:
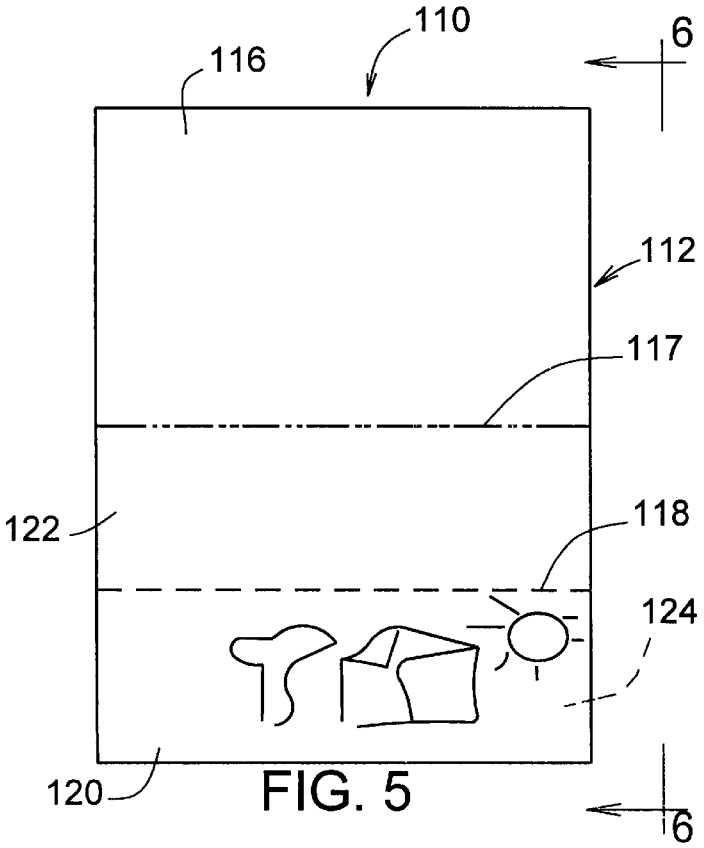
FIG. 5 is a back view of the greeting card of FIG. 4.
Figure 6:
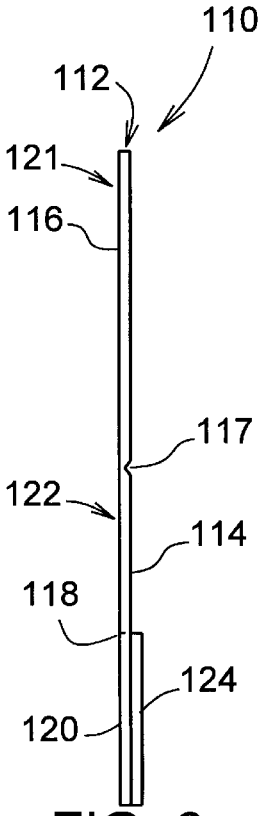
FIG. 6 is a side edge view of the greeting card of FIG. 4 as seen in the direction of arrows 6—6 in FIG. 5.

With reference to FIGS. 4–6 there is shown an embodiment of a greeting card, generally denoted as the numeral 110, of the present invention. The greeting card 110 is formed of a planar blank 112 having a first planar surface 114 and a second planar surface 116. The planar blank 112 is formed with a fold line 117 extending across the planar blank 112 dividing the planar blank 112 into a first portion 119 and a second portion 121. The first portion 119 can be folded relative to the second portion 121 into and out of overlaying relationship about the fold line 117. One portion, for example the first portion 119, can be formed with a line of perforations 118 extending across the first portion 119 generally parallel to the fold line 117 dividing the first portion 119 into a first section 120 and a second section 122. A thin, flexible, magnetic sheet material 124 is adhesively secured to, for example, the first surface 114 of, for example, the first section 120. The thin, flexible, magnetic sheet material 124 is dimensionally coextensive with the first surface 114 of the first section 120. The second surface 116 of the first section 120 as well as the second surface 116 of the second section 122 can be formed with indicia such as an attractive scene or art work and the like.

The entire greeting card 110 can be magnetically secured to a magnetic surface to display the entire card 110, or the first section 120 can be separated from the second section 122 along the line of perforations 118 and the separated first section 120 can be magnetically secured to a magnetic surface, such as a refrigerator door or metallic bulletin board, to display the indicia on the second surface 116 of the first section 120. Also, the first section 120 can be used to magnetically attach other sheets of paper, such as notes, and the like, to the magnetic surface.

Figure 7:
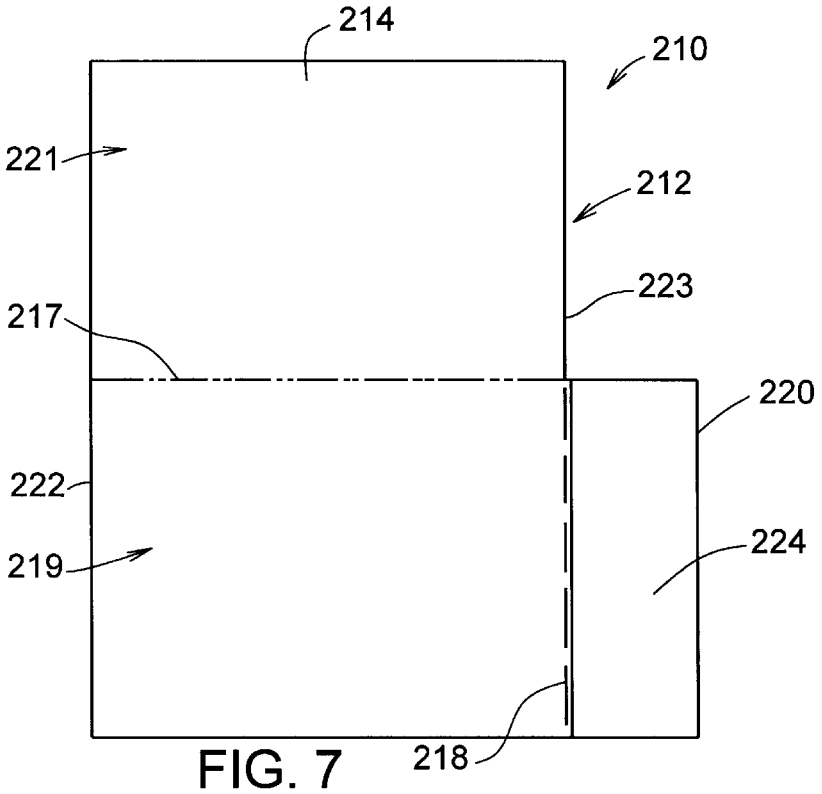
FIG. 7 is a front view of another embodiment of a greeting card incorporating features of the present invention.
Figure 8:
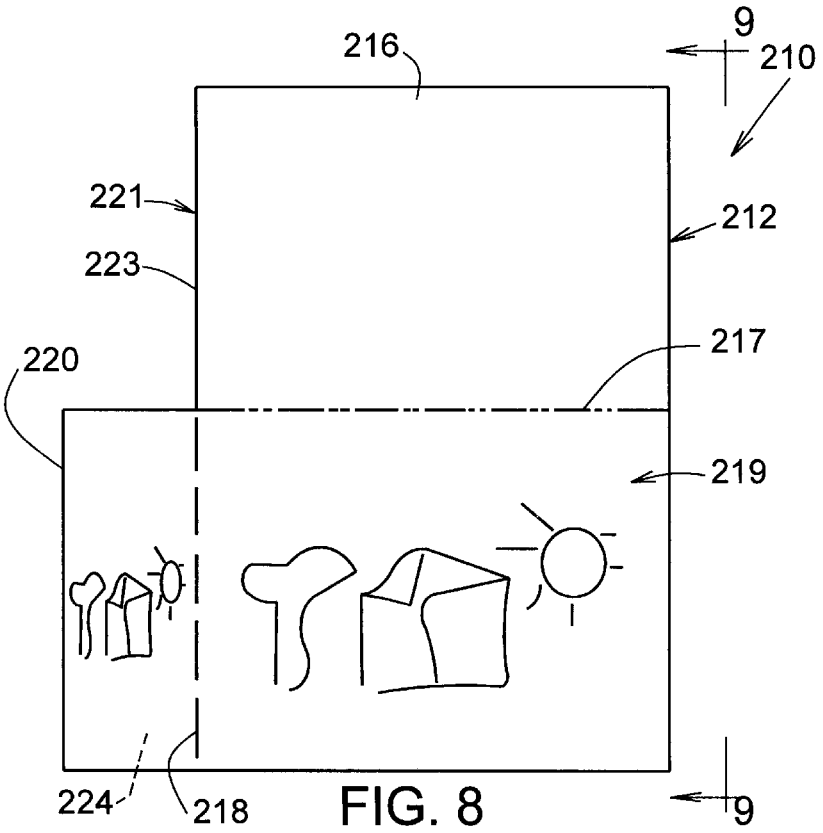
FIG. 8 is a back view of the greeting card of FIG. 7.
Figure 9:
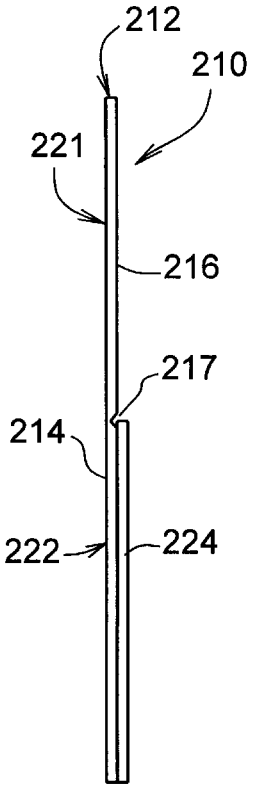
FIG. 9 is a side edge view of the greeting card of FIG. 7 as seen in the direction of arrows 9—9 in FIG. 8.

Now with reference to FIGS. 7–9, there is shown another embodiment of a greeting card, generally denoted as the numeral 210 of the present invention. The greeting card 210 is formed of a planar blank 212 having a first planar surface 214 and a second planar surface 216. The planar blank 212 is formed with a fold line 217 extending across the planar blank 212 dividing the planar blank 212 into a first portion 219 and a second portion 221. The first portion 219 can be folded relative to the second portion 221 into and out of mutual overlaying relationship about the fold line 217. One portion, for example the first portion 219, is wider than the second portion 221, and can be formed with a line of perforations 218 extending across the first portion 219 perpendicular to the fold line 217 and in alignment with the adjacent side edge 223 of the second portion 221 dividing the first portion 219 into a first section 220 and a second section 222. A thin, flexible, magnetic sheet material 224 is adhesively secured to, for example, the first surface 214 of, for example, the first section 220. The thin, flexible, magnetic sheet material 224 is dimensionally coextensive with the first surface 214 of the first section 220. The second surface 216 of the first section 220 as well as the second surface 216 of the second section 222 can be formed with indicia such as an attractive scene, art work, or writing, and the like.

The entire greeting card 210 can be magnetically secured to a magnetic surface to display the entire card 210, or the first section 220 can be separated from the second section 222 along the line of perforations 218 and the separated first section 220 can be magnetically secured to a magnetic surface, such as a refrigerator door or metallic bulletin board, to display the indicia on the section surface 216 of the first section 220. Also, the first section 220 can be used to magnetically attach other sheets of paper, such as notes and the like, to the magnetic surface.

Figure 10:
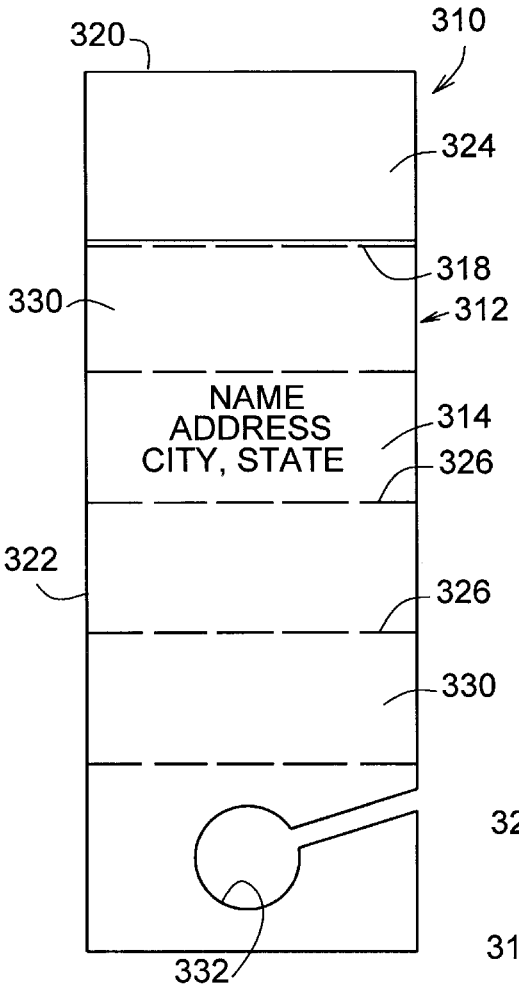
FIG. 10 is a front view of an advertising card incorporating features of the present invention.
Figure 12:
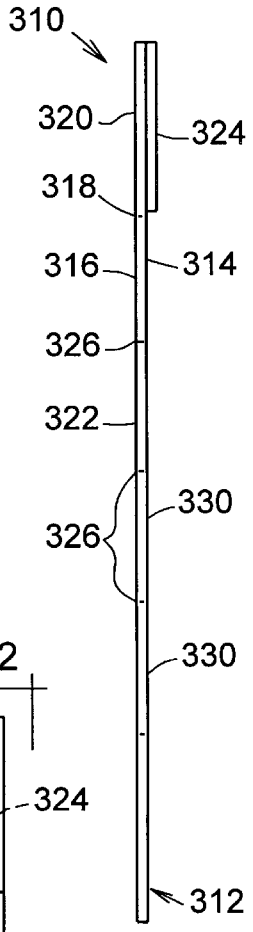
FIG. 12 is a side edge view of the advertising card of FIG. 10 as seen in the direction of arrows 12—12 in FIG. 11.
Figure 11:
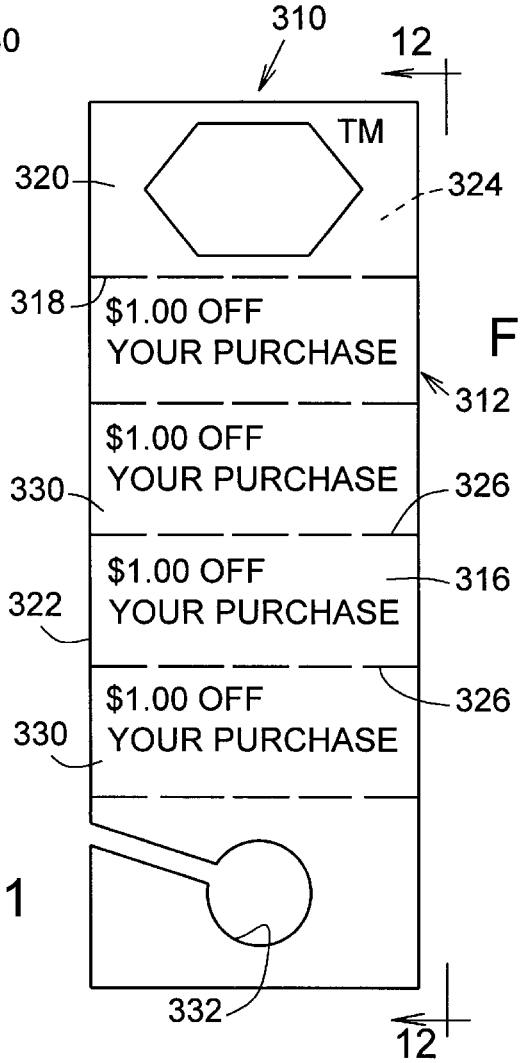
FIG. 11 is a back view of the advertising card of FIG. 10.
Figure 13:
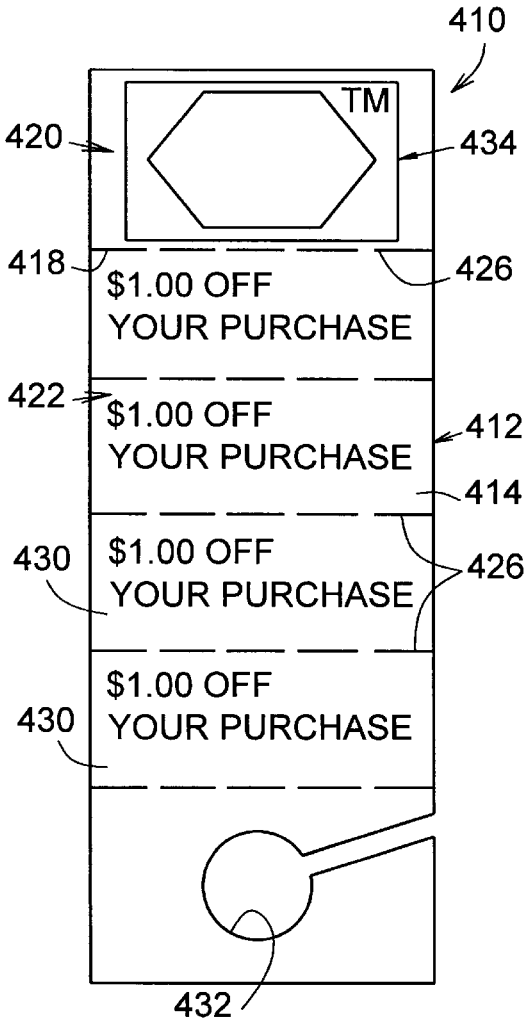
FIG. 13 is a front view of yet another embodiment of an advertising card incorporating features of the present invention.
Figure 14:
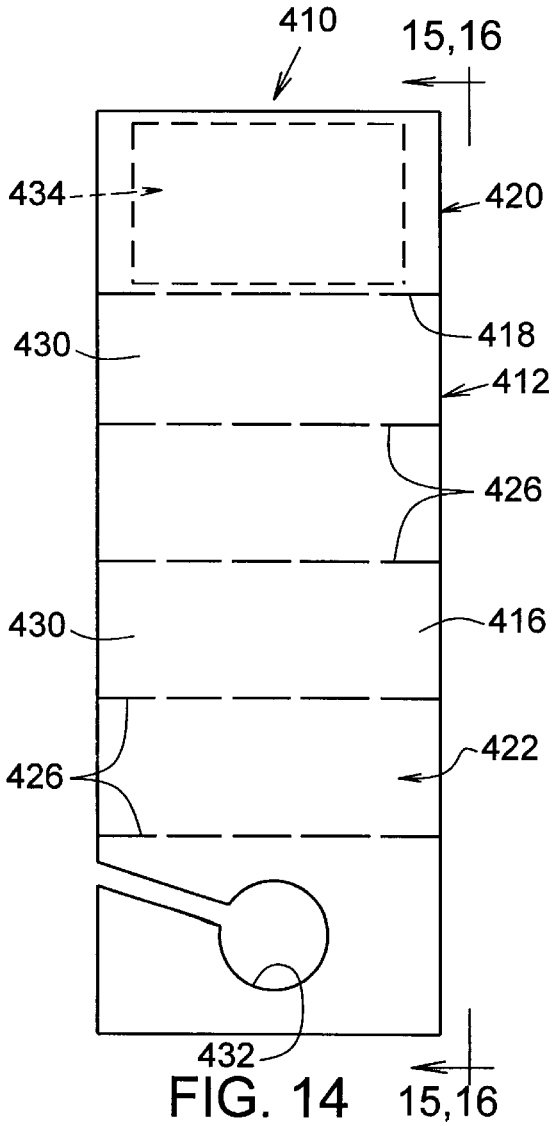
FIG. 14 is a back view of the advertising card of FIG. 13.

Turning now to FIGS. 10–12, there is shown an embodiment of an advertising card, generally denoted as the numeral 310 of the present invention. The advertising card 310 is formed of a planar blank 312 having a first planar surface 314 and a second planar surface 316. The planar blank 312 is formed with a line of perforations 318 extending across the planar blank 312 dividing the planar blank into a first section 320 and a second section 322. The line of perforations 318 provides for separating the first section 320 from the second section 322. A thin, flexible magnetic sheet material 324 is adhesively secured to, for example, the first surface 314 of, for example, the first section 320. The thin, flexible, magnetic sheet material 324 is dimensionally coextensive with the first surface 314 of the first section 320. The second surface 316 of the first section 320 can be printed with indicia such as a business trademark or service mark, for example. The second section 322 can be formed with second perforated lines 326 defining a plurality of subsections 330 which an be individually separated along the perforated lines 326. The second surface 316 of the subsections 330 can be printed with indicia representing, for example, promotional purchase coupons. Also, the first surface 314 of the second section 322 can be printed with indicia.

The advertising card 310 can be used as a mailer, an insert in newspapers or magazines, or as a door hanger to be hung on home doors. In the event the advertising card 310 is used as a mailer, the front surface 314 second section 322 can be printed with addressee information and include an area for postage. In the event that the advertising card 310 is to be used as a door hanger, the second section can be formed with a cut-out 332 to receive a door knob.

The advertising card 310 can be magnetically secured to a magnetic surface, such as a refrigerator door or metallic bulletin board, to promotionally display the purchase coupons 330. Also, when the coupons 330 have been used, the first section 320 can be separated along the line of perforations 318. The separated first section 320 can be magnetically secured to a magnetic surface, such as a refrigerator door or metallic bulletin board to magnetically attach other sheets of paper, such as notes and the like, to the magnetic surface while showing the trademark or service mark on the first section 320.

Figure 15:
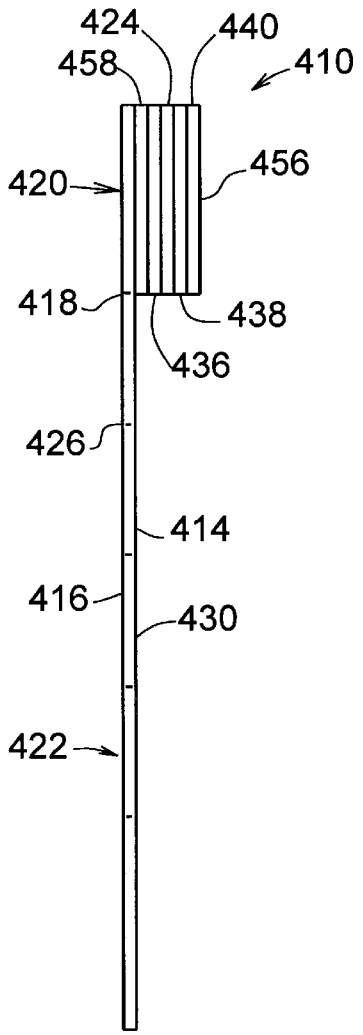
FIG. 15 is a side edge view of the advertising card of FIG. 13 as seen in the direction of arrows 15—15 in FIG. 14.
Figure 16:
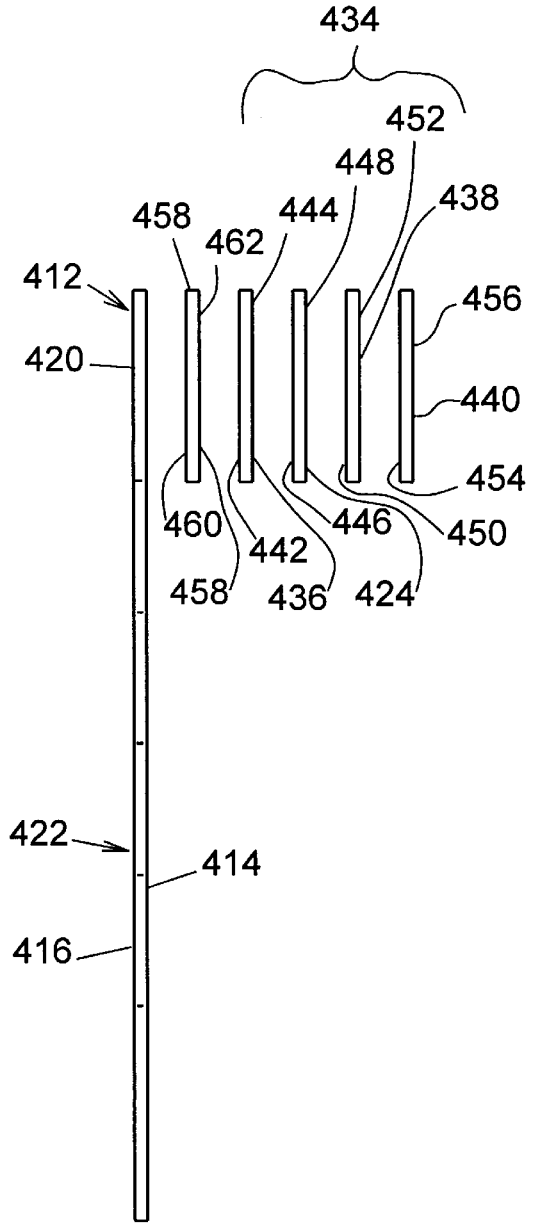
FIG. 16 is an enlarged, exploded side edge view of a portion of the card of FIG. 13 as seen in the direction of arrows 16—16 in FIG. 14.

Now turning to FIGS. 13–16, there is shown another embodiment of an advertising card, generally denoted as the numeral 410 of the present invention. The advertising card 410 is formed of a planar blank 412 having a first planar surface 414 and a second planar surface 416. The advertising card 410 further comprises a magnetized label, generally denoted as the numeral 434, removably adhered to the first planar surface 414 of the blank 412. In FIGS. 15 and 16, the thickness of the label 412 is exaggerated to clearly show its various components. The magnetized label 434 comprises a first sheet or layer of vinyl 436, a thin sheet of flexible magnetic material 424, a sheet or layer of double-backed tape 438, and a second sheet or layer of vinyl 440. The first sheet of vinyl 436 has a back surface 442 and a front surface 444 with a pressure-sensitive adhesive coating only the back surface 442. The sheet of flexible magnetic material 424 has a back surface 446 and a front surface 448, and is substantially identical in peripheral shape with the peripheral shape of the first vinyl sheet 436. The magnetic material sheet 424 overlays the first vinyl sheet 436 with the back surface 446 of the magnetic sheet 424 in registered contact with the front surface 444 of the first vinyl sheet 436 so that the magnetic sheet 424 is adhesively secured to the front surface of the first vinyl sheet 436. The sheet of tape 438 has a back surface 450 and a front surface 452, and is substantially identical in peripheral shape with the peripheral shape of the magnetic sheet 424. Both the back surface 450 and front surface 452 of the tape sheet 438 are coated with an adhesive material. The tape sheet 438 overlays the magnetic sheet 424 with the back surface 450 of the tape sheet 438 in registered contact with the front surface 448 of the magnetic sheet 424 so that the tape sheet 438 is adhesively secured to the front surface 448 of the magnetic sheet 424. The second vinyl sheet 440 has a back surface 454 and a front surface 456, and is substantially identical in peripheral shape with the peripheral shape of the tape sheet 438. Indicia, such as a business trademark or service mark is printed on the second vinyl sheet 440. The second vinyl sheet 440 overlays the tape sheet 438 with the back surface 454 of the second vinyl sheet 440 in registered contact with the front surface 452 of the sheet of tape 438 so that the second vinyl sheet 440 is adhesively secured to the tape sheet 438.

With continued reference to FIGS. 13 through 16, the magnetic label 434 is removably held by adhesion to the planar blank 412 by means of a third sheet or layer of vinyl 458. The third sheet of vinyl 458 has a back surface 460 and a front surface 462, and is substantially identical in peripheral shape with the peripheral shape of the first vinyl sheet 436 of the label 434. A pressure-sensitive adhesive coating covers only the back surface 460 of the third vinyl sheet 458. The third vinyl sheet 458 overlays a portion of the first planar surface 414 of the planar blank 412 with the back surface 414 of the third vinyl sheet 458 in contact with the first planar surface 414 of the blank 412. The label 434 overlays the third vinyl sheet 458 with the back surface 442 of the first vinyl sheet 436 of the third vinyl sheet 458 so that the label 434 clings to the third vinyl sheet by adhesion or an incumbent mutually attractive force, to hold the label 434 to the third vinyl sheet 458 by a static charge incumbent between the back surface 460 of the first vinyl sheet 436 and the front surface 462 of the third vinyl sheet 458.

The advertising card 410 can be magnetically secured to a magnetic surface. Also, the magnetic label 434 can be easily separated from the planar blank 412 by merely peeling the label 434 from the third vinyl sheet 458. The separated magnetic label 434 can be magnetically secured to a magnetic surface, such as a refrigerator door or a metallic bulletin board, to display the indicia on the second vinyl sheet 440. Also, the magnetic label 434 can be used to magnetically attach other sheets of paper, such as notes and the like, to the magnetic surface.

The planar blank 412 can be formed with a perforated line 418 dividing the blank 412 into a first section 420 and a second section 422. The magnetic label 434 can be located on the first surface 414 of the first section 420, and the second section 422 can be formed with perforated lines 426 defining a plurality of sub-sections 430 which can be individually separated along the perforated lines 426. These subsections 430 can be printed on the first surface 414 with indicia representing, for example, promotional purchase coupons.

Figure 17:
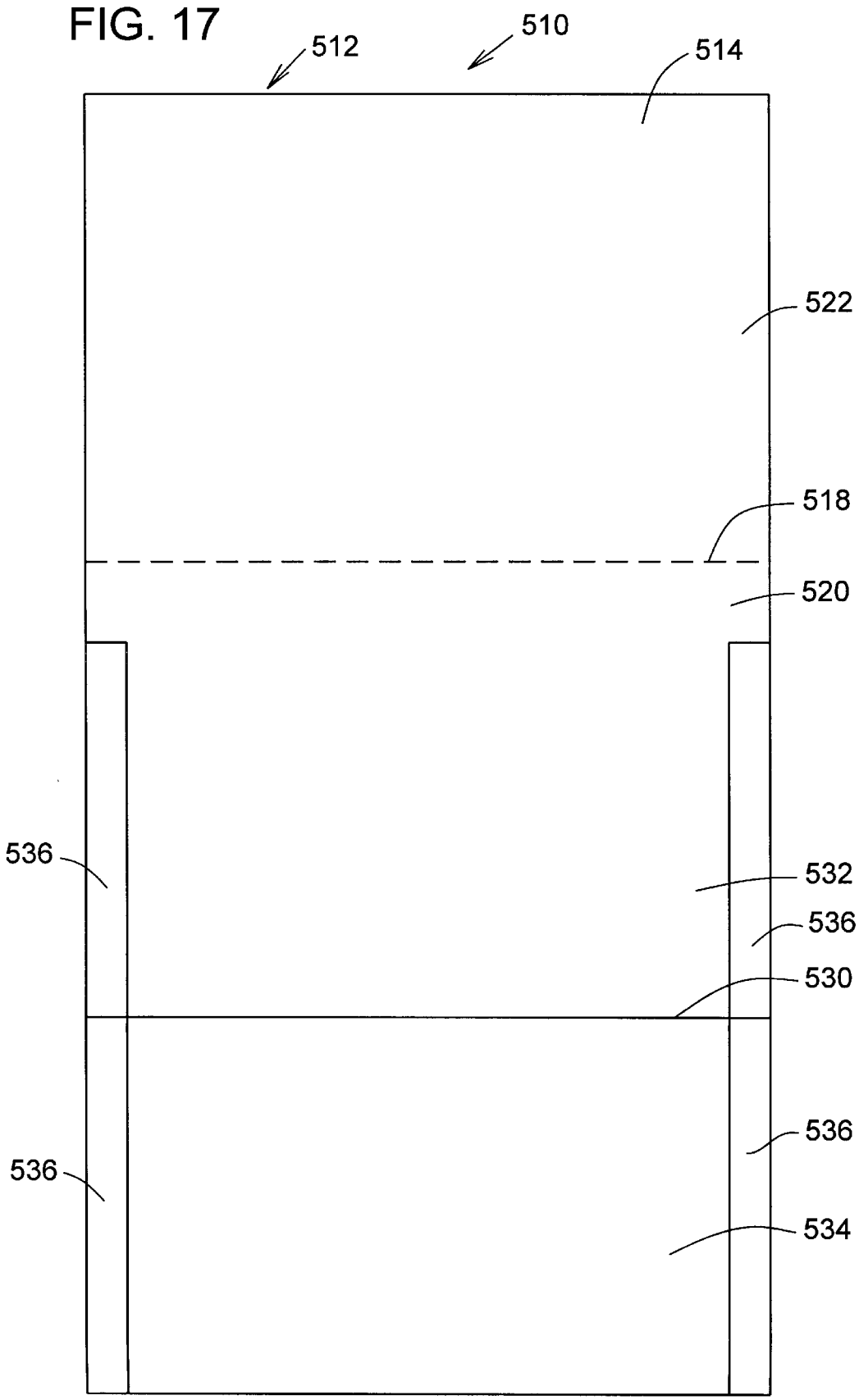
FIG. 17 is a front view of a card before folding to form a pocket.

With reference to FIGS. 17–23, a magnetic pocket card 510 is shown. FIG. 17 shows a planar blank 512 before folding to form a pocket, shown in later figures as numeral 540. Planar blank 512 has a first or front planar surface 514 and an opposed second or rear planar surface 516. A line of perforations 518 divides blank 512 into a first or pocket section 520 and a second section 522. Alternatively, instead of a perforation line 518, a fold line could be used, but sections 520 and 522 would not be as easily or as cleanly separable. A fold line or crease 530 divides first section 520 into a pocket back portion 532 and a pocket front portion 534. Portion 534 will be folded up against portion 532 and secured along side edges, for example, by an adhesive 538. Depending on the material of construction of the planar blank 512, alternative securing means such as stapling or heat sealing could be utilized. The numeral 536 demonstrates the areas on first section 520 where adhesive 538 could be placed.

Figure 18:
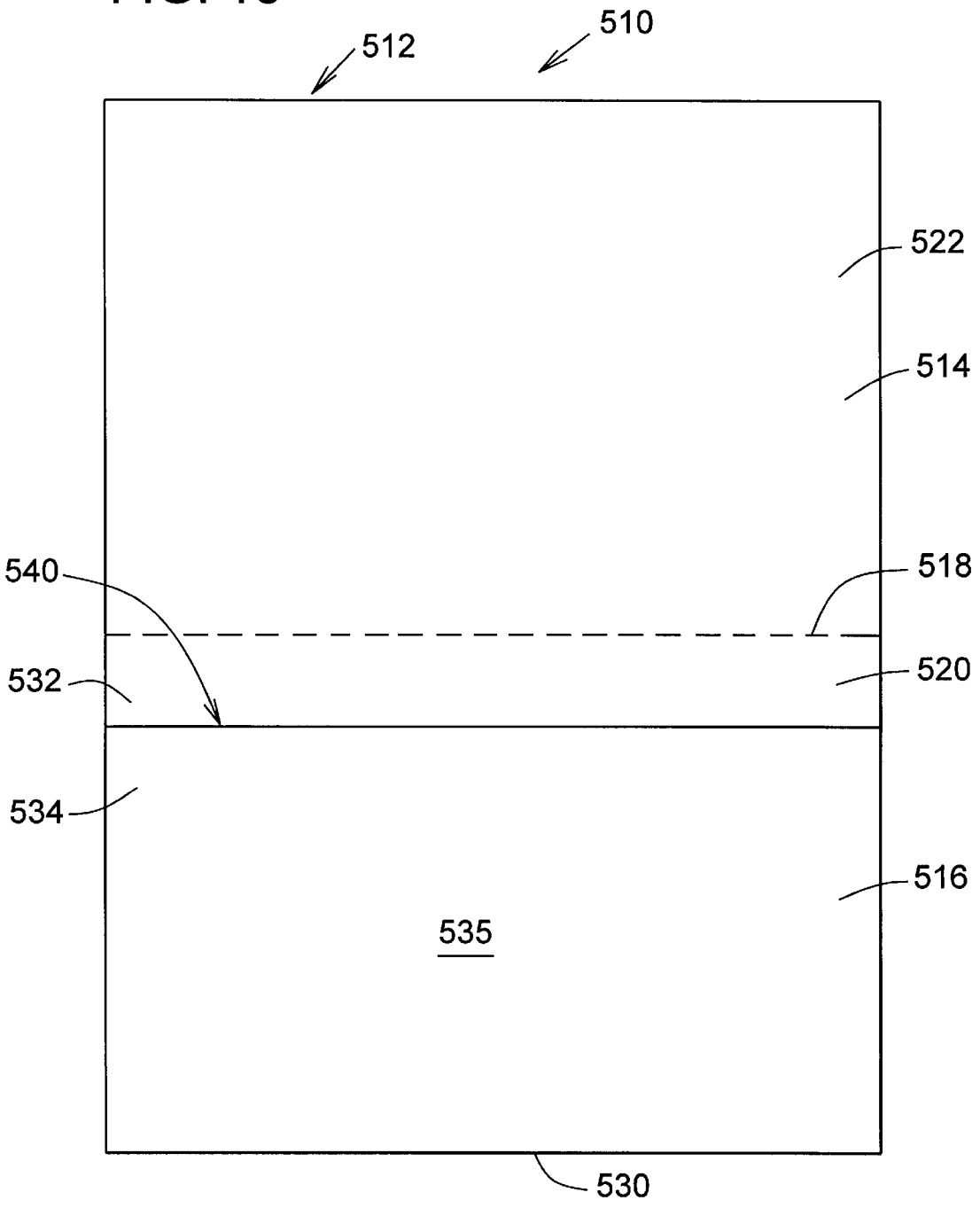
FIG. 18 is a front view of the card of FIG. 17, the planar blank having been folded to form a pocket.

FIG. 18 shows pocket 540 formed by securing portion 534 to portion 532 along the sides of the portions 534 and 532. A logo or other advertising can be placed on the facing portion of pocket front portion 534, as noted by the numeral 535. Advertising, coupons, address labels, or the like could be placed on the facing surface of section 522. The coupons may or may not be perforated.

Figure 19:
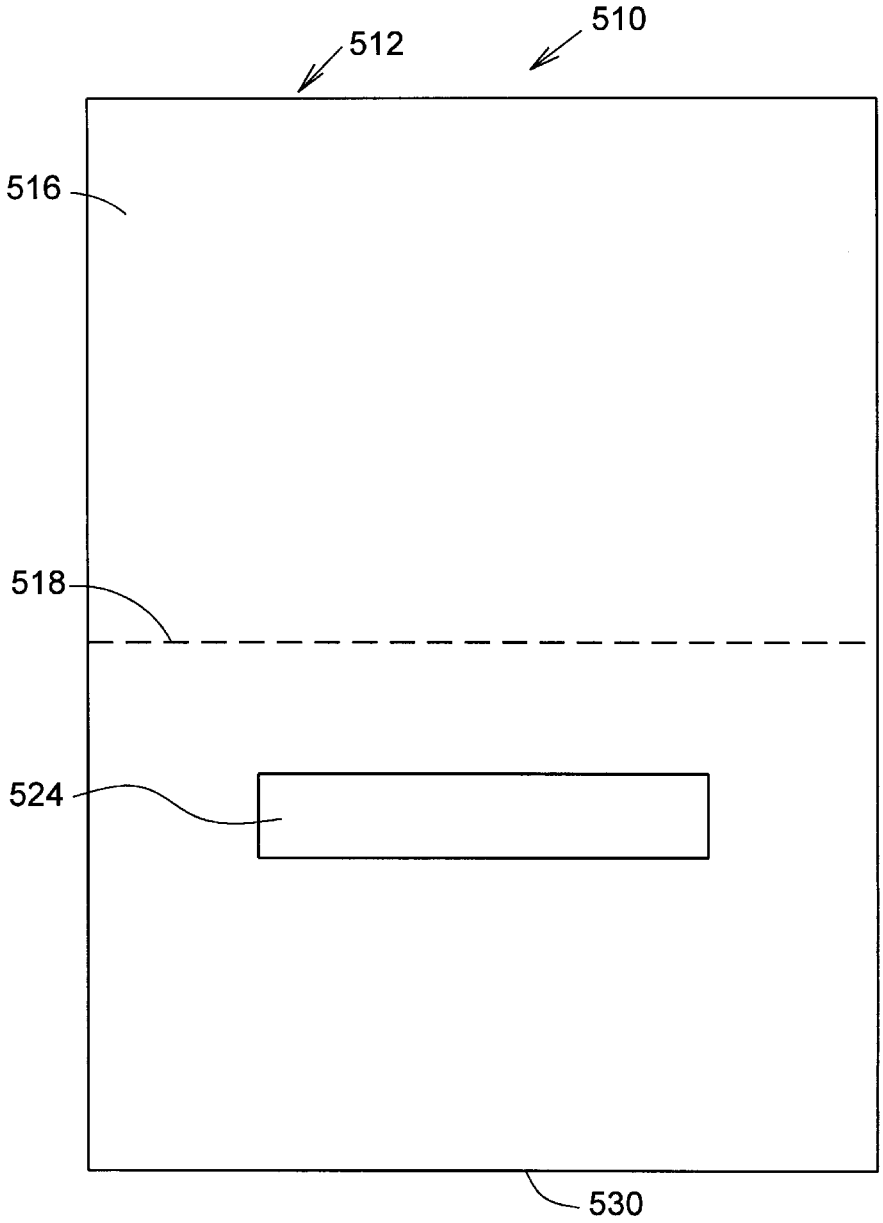
FIG. 19 is a back view of the card having a pocket of FIG. 18.
Figure 20:
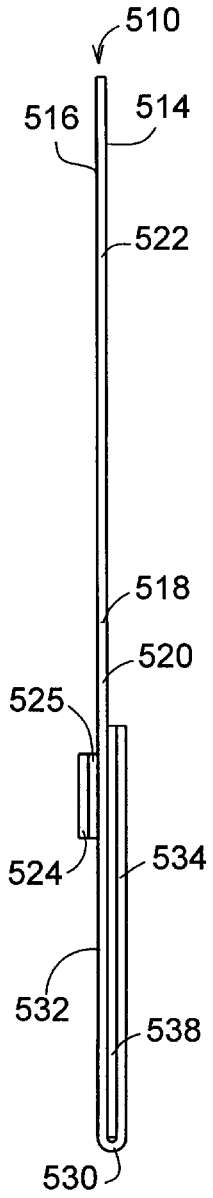
FIG. 20 is a side view of the card of FIG. 19.

FIG. 19 shows the pocket card of FIG. 18 from the reverse and FIG. 20 shows the card from the side or edge. Magnetic sheet material 524 sized to magnetically retain the pocket card 510 and the contents of pocket 540 to a magnetic substance, for example, the side of a refrigerator, has adhesive 525 thereon. Using adhesive 525, magnetic sheet material 524 is adhesively attached to second planar surface 516 in first section 520.

Figure 21:
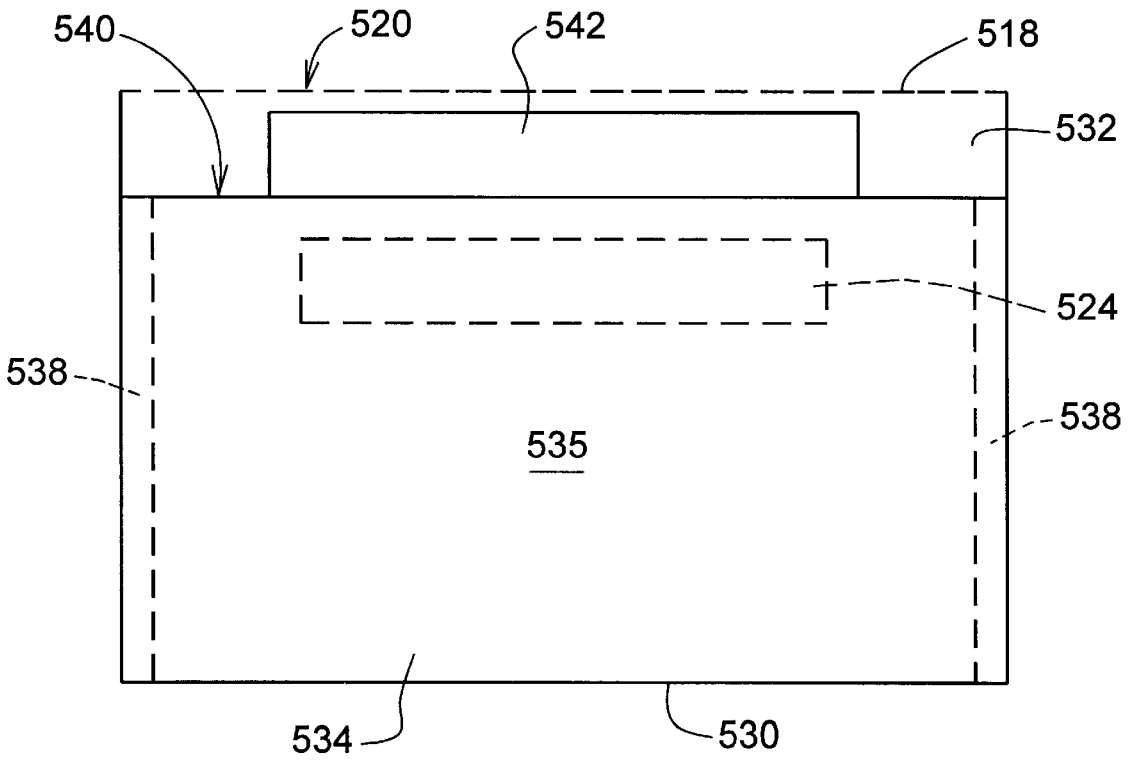
FIG. 21 is a front view of the card of FIG. 18 without a second section.

FIG. 21 shows pocket card 510 having no second section 522. This would be the preferred configuration for magnetically attaching the pocket card to a magnetic surface for use. Second section 522 may have been detached from first section 520 by tearing along perforation line 518. Alternatively, for example, pocket card 510 could even be simply produced having only first section 520. Phantom lines show magnetic sheet material 524 on the reverse and phantom lines 538 demonstrate how portions 534 and 532 could be secured to form pocket 540. Pocket 540 is shown having an insert 542 therein. Examples of possible inserts include a menu for a carry-out restaurant, a plurality of coupons, a telephone listing.

Figure 22:
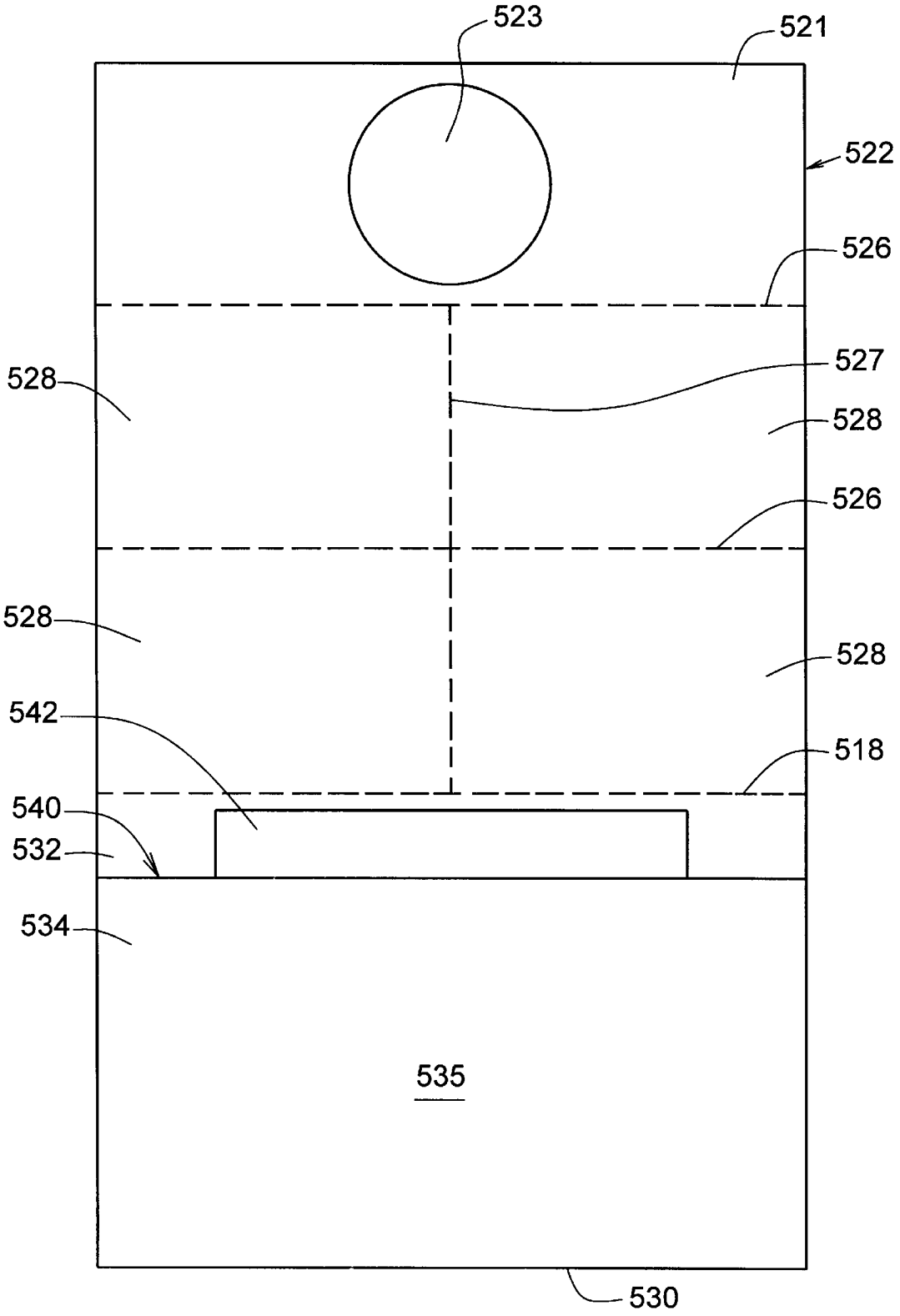
FIG. 22 is a card similar to the pocket card of FIGS. 17–21 with a modified second section; and, FIG. 23 is a card similar to the pocket cards of FIGS. 17–21 with an alternative modified second section.
Figure 23:
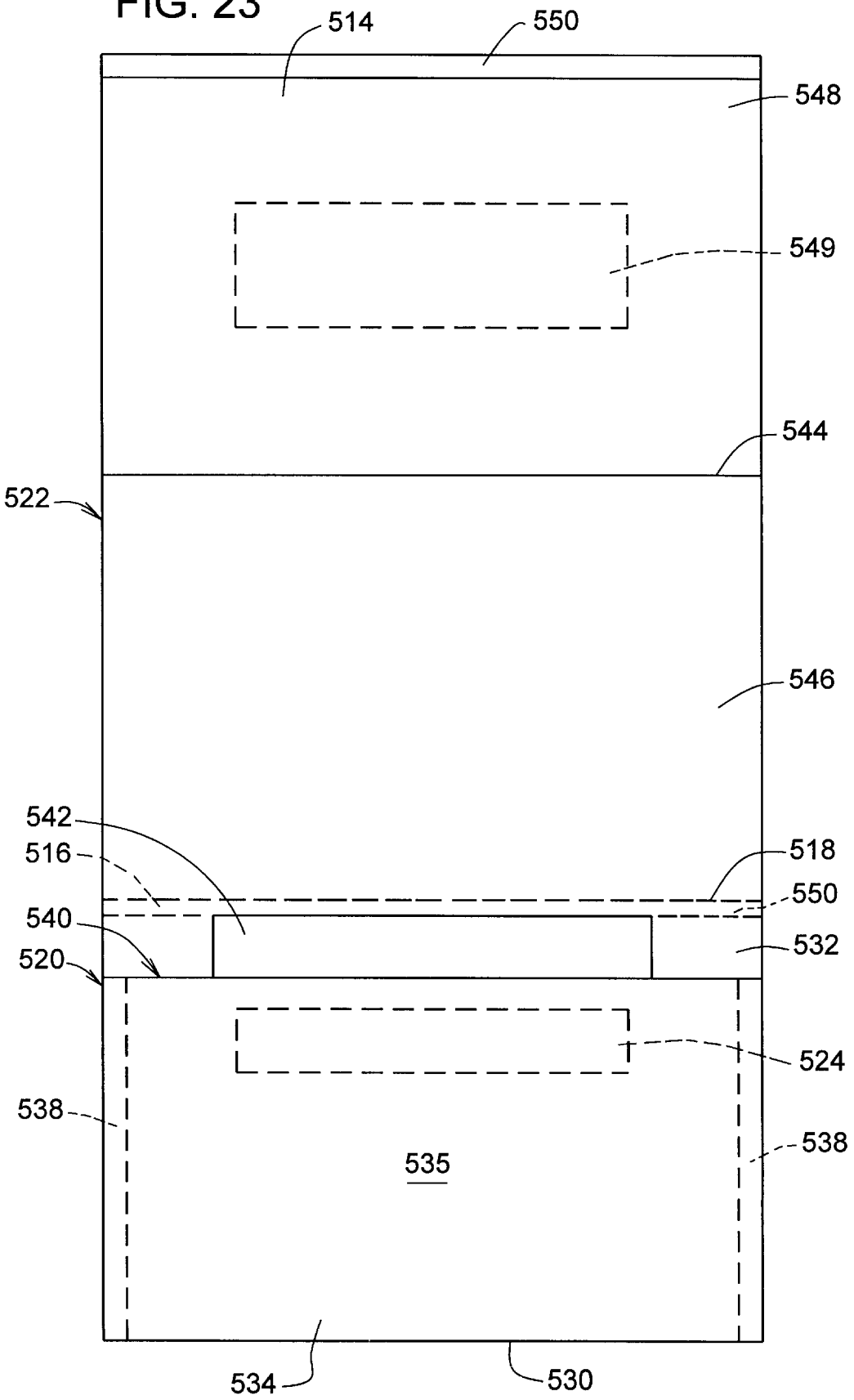

Many distribution methods are currently available. FIGS. 22 and 23 show pocket cards having alternative second sections 522. The pocket card of FIG. 22 is designed as a hang card while the pocket card of FIG. 23 is designed for mailing.

The card of FIG. 22 is shown with second section 522 divided into a coupon area and a hang tag area. The coupon area is shown having four coupons 528 as an example. To form four coupons, a pair of perforation lines 526, parallel perforation line 518, are placed onto section 522. A perforation line 527, transverse to perforation lines 526 and 518, is placed onto section 522. Perforation lines 518, 526, 526 and 527 form the four coupons 528. Hang tab 521 is adjacent perforation line 526 furthest from pocket 540. Hang tab 521 is shown having a circular opening 523. Openings such as shown in FIGS. 10 and 11 could also be employed.

The card of FIG. 23 is shown with second section 522 sized to wrap around the pocket front 534 and pocket back 532 and be secured thereto for mailing or bulk delivery. This protects the magnetic material 524 and the insert 542. Section 522 is sized to have a length approximately twice the length from perforation line 518 to fold line 530. Fold line 544 equally divides section 522 into an insert retaining flap 546, adjacent perforation line 518, and an address/magnet protecting flap 548. With insert 542 in pocket 540, flap 546 is folded down over pocket 540 using perforation line 518. Then, using fold line 544, flap 548 is folded up to protect magnetic material 524. Flap 548 can be, for example, adhesively secured to pocket back 532. For example, possible adhesive locations 550 are identified on the tip of flap 548 on the first planar surface 514 and on the second planar surface 516 of pocket back 532. Alternatively, so that opening the package did not damage the pocket card, flap 548 could be extended so that it could fold further to be adhesively secured to flap 546. For distribution through the mails or courier delivery, an address label 549 can be affixed to flap 548, for example, on the second planar surface 516. Alternatively, address label 549 could be affixed to flap 546 on the second planar surface 516.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A magnetic pocket card comprising:

a planar blank, said planar blank having a first planar surface and a second planar surface, said planar blank having a dividing line dividing said planar blank into a first section and a second section;

said first section having a fold line thereacross, said fold line being in a parallel relationship with said dividing line, said fold line dividing said first section into a pocket back portion and a pocket front portion, said pocket back portion and said second section being in an adjacent relationship, said first section being folded along said fold line, said pocket front portion being secured to said pocket back portion at at least one preselected location on said first planar surface thereby forming a pocket between said pocket back portion and said pocket front portion; and, a thin, flexible, magnetic sheet material having magnetic materials therein, said magnetic sheet material being capable of magnetically holding said magnetic pocket card to a magnetic substance, said magnetic sheet material being secured to said second planar surface on said pocket back portion, where said dividing line is a perforated line.

2. The magnetic pocket card of claim 1, further comprising an insert, said insert being received in said pocket.

3. The magnetic pocket card of claim 2, where said insert is selected from the group consisting of a menu, at least one coupon, an address list, and a telephone list.

4. The magnetic pocket card of claim 1, said second section having at least one perforation line thereacross.

5. The magnetic pocket card of claim 4, said second section having a transverse perforation line, said transverse perforation line and said at least one perforation line thereacross being in a perpendicular relationship.

6. The magnetic pocket card of claim 1, said second section including a hang tab, said hang tab having an opening therethrough.

7. A magnetic pocket card comprising:

a planar blank, said planar blank having a first planar surface and a second planar surface, said planar blank having a dividing line dividing said planar blank into a first section and a second section;

said first section having a fold line thereacross, said fold line being in a parallel relationship with said dividing line, said fold line dividing said first section into a pocket back portion and a pocket front portion, said pocket back portion and said second section being in an adjacent relationship, said first section being folded along said fold line, said pocket front portion being secured to said pocket back portion at at least one preselected location on said first planar surface thereby forming a pocket between said pocket back portion and said pocket front portion; and, a thin, flexible, magnetic sheet material having magnetic materials therein, said magnetic sheet material being capable of magnetically holding said magnetic pocket card to a magnetic substance, said magnetic sheet material being secured to said second planar surface on said pocket back portion;

where said pocket back portion has a preselected height, where said second section has an insert retaining portion adjacent said pocket back portion, said insert retaining portion has a first height, said first height being approximately equal said pocket back portion preselected height, where said second section has a magnet protecting portion, said magnet protecting portion having a second height, said second height being at least equal to said pocket back portion preselected height, said second section insert retaining portion and said magnet protecting portion having a second section fold line therebetween, whereby said insert retaining portion is folded over said pocket and said magnet protecting portion is folded over said pocket back portion of said second planar surface.

8. The magnetic pocket card of claim 7, said magnet protection portion having an address label attached thereto, said address label being attached to said second planar surface portion.

9. The magnetic pocket card of claim 7, said insert retaining portion having an address label attached thereto, said address label being attached to said second planar surface portion.

10. The magnetic pocket card of claim 7, said second section having an address label attached thereto, said address label being attached to said second planar surface portion.

11. The magnetic pocket card of claim 7, further comprising an insert, said insert being received in said pocket.

12. The magnetic pocket card of claim 11, where said insert is selected from the group consisting of a menu, at least one coupon, an address list, and a telephone list.

* * * * *